US007275668B1

(12) United States Patent
Carroll

(10) Patent No.: US 7,275,668 B1
(45) Date of Patent: Oct. 2, 2007

(54) UMBRELLA/CUP HOLDER DEVICE

(76) Inventor: Emmitt Carroll, 4023 O St. #2, Bakersfield, CA (US) 93301

( * ) Notice: Subject to any disclaimer, the term of this patent is extended or adjusted under 35 U.S.C. 154(b) by 511 days.

(21) Appl. No.: 10/713,693

(22) Filed: Nov. 14, 2003

(51) Int. Cl.
*A45B 11/02* (2006.01)

(52) U.S. Cl. ..... 224/190; 135/16; 224/666; 224/600

(58) Field of Classification Search ..... 224/186, 224/187, 188, 189, 190, 600, 260, 647, 666, 224/673; 135/16
See application file for complete search history.

(56) References Cited

U.S. PATENT DOCUMENTS

| | | | | | |
|---|---|---|---|---|---|
| 191,782 | A * | 6/1877 | Smith, Sr. | 224/190 |
| 225,406 | A * | 3/1880 | Mora | 70/40 |
| 791,855 | A * | 6/1905 | Alexander | 224/189 |
| 903,682 | A * | 11/1908 | Cumpston | 224/190 |
| 988,485 | A * | 4/1911 | Michell | 224/186 |
| 1,262,402 | A * | 4/1918 | Stuckey | 224/190 |
| 2,085,984 | A | 7/1937 | Kruithof | |
| 2,576,624 | A * | 11/1951 | Miller | 248/514 |
| 3,204,650 | A * | 9/1965 | Shinew | 135/16 |
| 4,537,339 | A | 8/1985 | Pearson | |
| 5,353,977 | A | 10/1994 | Schiro, Jr. et al. | |
| D361,654 | S | 8/1995 | Petracco | |
| 5,513,786 | A | 5/1996 | Drane | |
| 5,918,612 | A | 7/1999 | Hughes | |
| 6,923,357 | B2 * | 8/2005 | Smith | 224/605 |

* cited by examiner

*Primary Examiner*—Tri Mai

(57) ABSTRACT

An umbrella/cup holder device for allowing the user to carry other things while using an umbrella to protect oneself from inclement weather. The umbrella/cup holder device includes a harness including a pair of shoulder straps, a cross strap interconnecting the shoulder straps, and an adjustable belt being attached to the shoulder straps and having fastening members attached at ends thereof; and also includes an umbrella-holding bracket assembly being securely attached to one of the shoulder straps; and further includes a cup holder being securely attached to another of the shoulder straps; and also includes a pocket being securely attached to one of the shoulder straps for storing a folded-up umbrella therein.

9 Claims, 4 Drawing Sheets

UMBRELLA/CUP HOLDER DEVICE

BACKGROUND OF THE INVENTION

1. Field of the Invention

The present invention relates to umbrella/cup holders and more particularly pertains to a new umbrella/cup holder device for allowing the user to carry other things while using an umbrella to protect oneself from inclement weather.

2. Description of the Prior Art

The use of umbrella/cup holders is known in the prior art. More specifically, umbrella/cup holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,513,786; U.S. Pat. No. 5,918,612; U.S. Pat. No. 4,537,339; U.S. Pat. No. 2,085,984; U.S. Patent No. Des. 361,654; and U.S. Pat. No. 5,353,977.

While these devices fulfill their respective, particular objectives and requirements, the aforementioned patents do not disclose a new umbrella/cup holder device. The inventive device includes a harness including a pair of shoulder straps, a cross strap interconnecting the shoulder straps, and an adjustable belt being attached to the shoulder straps and having fastening members attached at ends thereof; and also includes an umbrella-holding bracket assembly being securely attached to one of the shoulder straps; and further includes a cup holder being securely attached to another of the shoulder straps; and also includes a pocket being securely attached to one of the shoulder straps for storing a folded-up umbrella therein.

In these respects, the umbrella/cup holder device according to the present invention substantially departs from the conventional concepts and designs of the prior art, and in so doing provides an apparatus primarily developed for the purpose of allowing the user to carry other things while using an umbrella to protect oneself from inclement weather.

SUMMARY OF THE INVENTION

In view of the foregoing disadvantages inherent in the known types of umbrella/cup holders now present in the prior art, the present invention provides a new umbrella/cup holder device construction wherein the same can be utilized for allowing the user to carry other things while using an umbrella to protect oneself from inclement weather.

The general purpose of the present invention, which will be described subsequently in greater detail, is to provide a new umbrella/cup holder device which has many of the advantages of the umbrella/cup holders mentioned heretofore and many novel features that result in a new umbrella/cup holder device which is not anticipated, rendered obvious, suggested, or even implied by any of the prior art umbrella/cup holders, either alone or in any combination thereof.

To attain this, the present invention generally comprises a harness including a pair of shoulder straps, a cross strap interconnecting the shoulder straps, and an adjustable belt being attached to the shoulder straps and having fastening members attached at ends thereof; and also includes an umbrella-holding bracket assembly being securely attached to one of the shoulder straps; and further includes a cup holder being securely attached to another of the shoulder straps; and also includes a pocket being securely attached to one of the shoulder straps for storing a folded-up umbrella therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new umbrella/cup holder device which has many of the advantages of the umbrella/cup holders mentioned heretofore and many novel features that result in a new umbrella/cup holder device which is not anticipated, rendered obvious, suggested, or even implied by any of the prior art umbrella/cup holders, either alone or in any combination thereof.

It is another object of the present invention to provide a new umbrella/cup holder device which may be easily and efficiently manufactured and marketed.

It is a further object of the present invention to provide a new umbrella/cup holder device which is of a durable and reliable construction.

An even further object of the present invention is to provide a new umbrella/cup holder device which is susceptible of a low cost of manufacture with regard to both materials and labor, and which accordingly is then susceptible of low prices of sale to the consuming public, thereby making such umbrella/cup holder device economically available to the buying public.

Still yet another object of the present invention is to provide a new umbrella/cup holder device which provides in the apparatuses and methods of the prior art some of the advantages thereof, while simultaneously overcoming some of the disadvantages normally associated therewith.

Still another object of the present invention is to provide a new umbrella/cup holder device for allowing the user to carry other things while using an umbrella to protect oneself from inclement weather.

Yet another object of the present invention is to provide a new umbrella/cup holder device which includes a harness including a pair of shoulder straps, a cross strap interconnecting the shoulder straps, and an adjustable belt being attached to the shoulder straps and having fastening members attached at ends thereof; and also includes an umbrella-holding bracket assembly being securely attached to one of the shoulder straps; and further includes a cup holder being securely attached to another of the shoulder straps; and also includes a pocket being securely attached to one of the shoulder straps for storing a folded-up umbrella therein.

Still yet another object of the present invention is to provide a new umbrella/cup holder device that is easy and convenient to use.

Even still another object of the present invention is to provide a new umbrella/cup holder device that is lightweight and securely supports a deployed umbrella and can be worn by adults and children alike.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
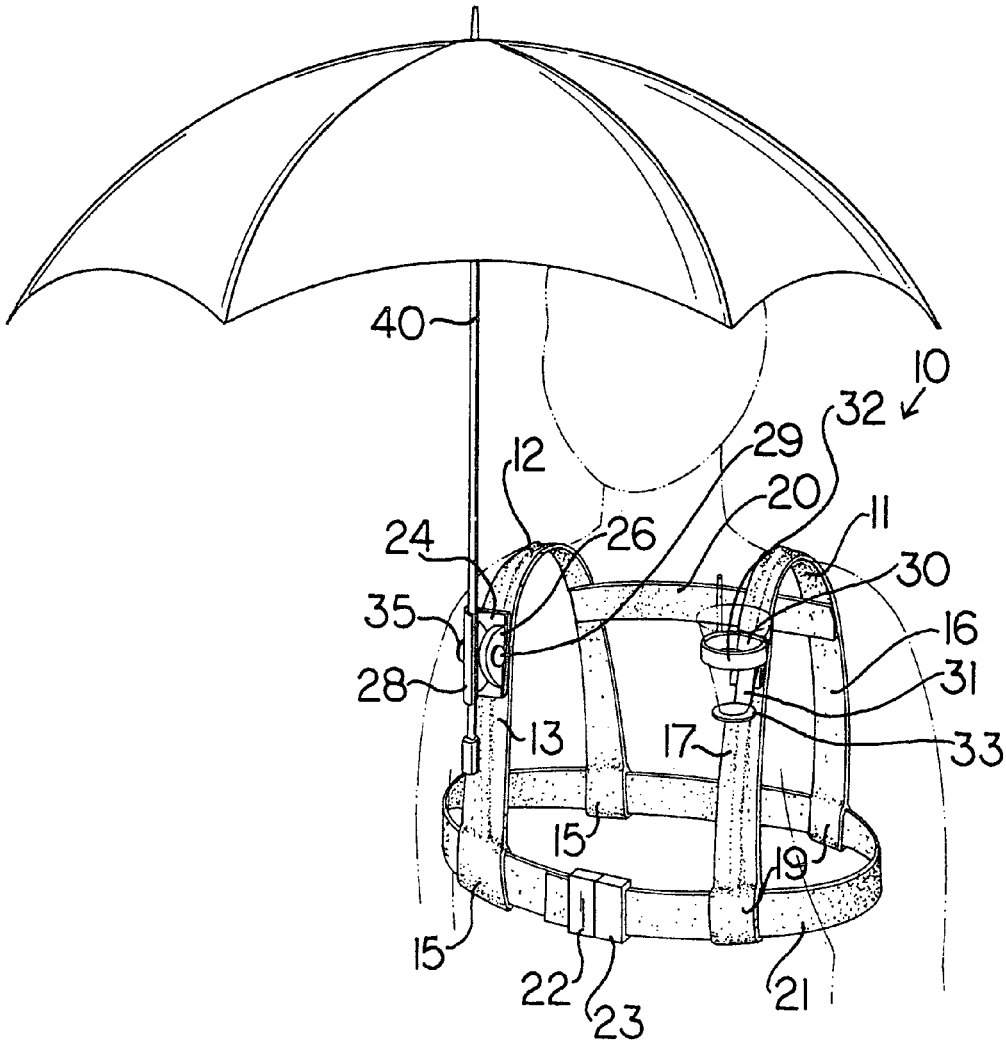
FIG. 1 is a perspective view of a new umbrella/cup holder device according to the present invention.
Figure 3:
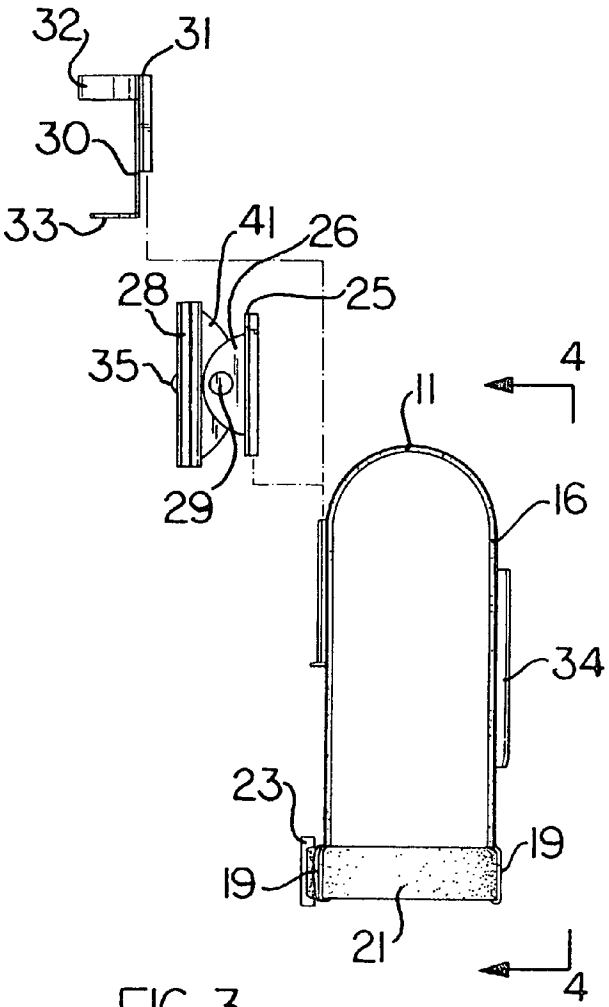
FIG. 3 is a side elevational view of the present invention.
Figure 2:
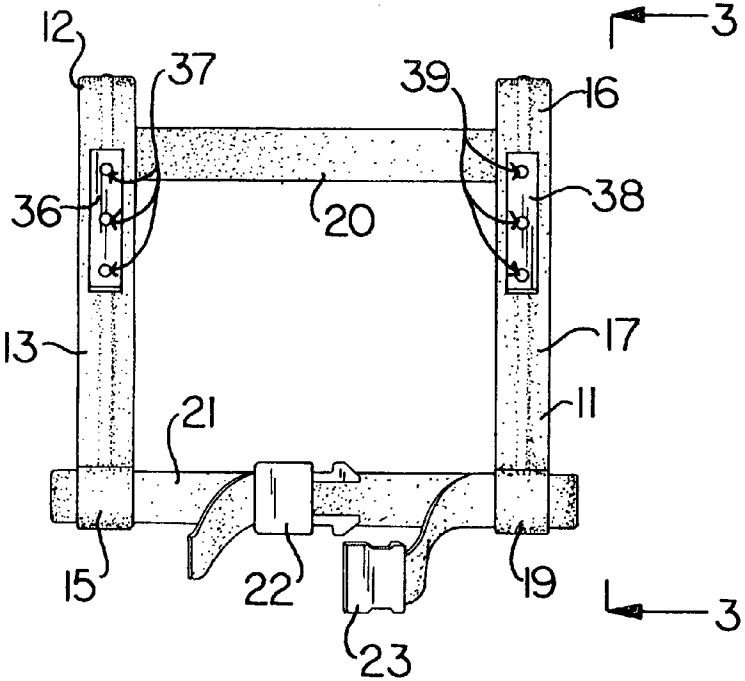
FIG. 2 is a front elevational view of the present invention.
Figure 4:
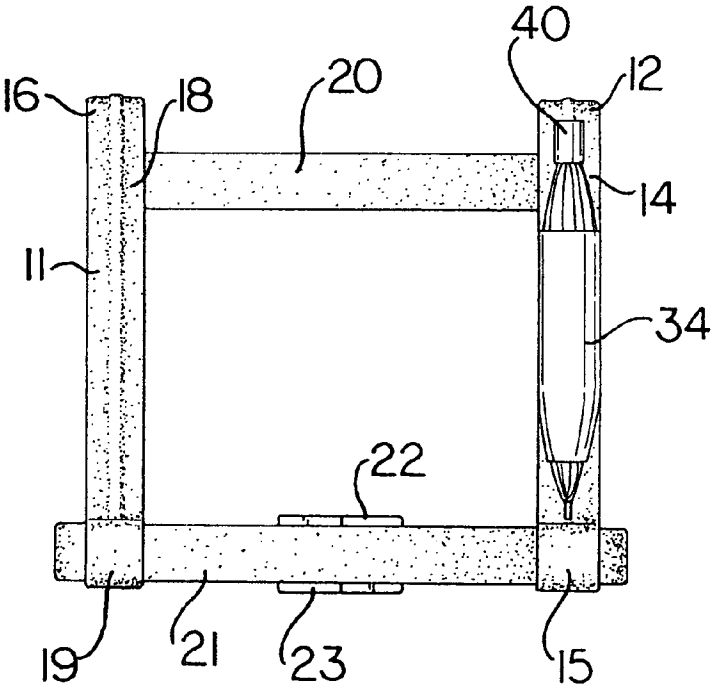
FIG. 4 is a rear elevational view of the present invention.
Figure 6:
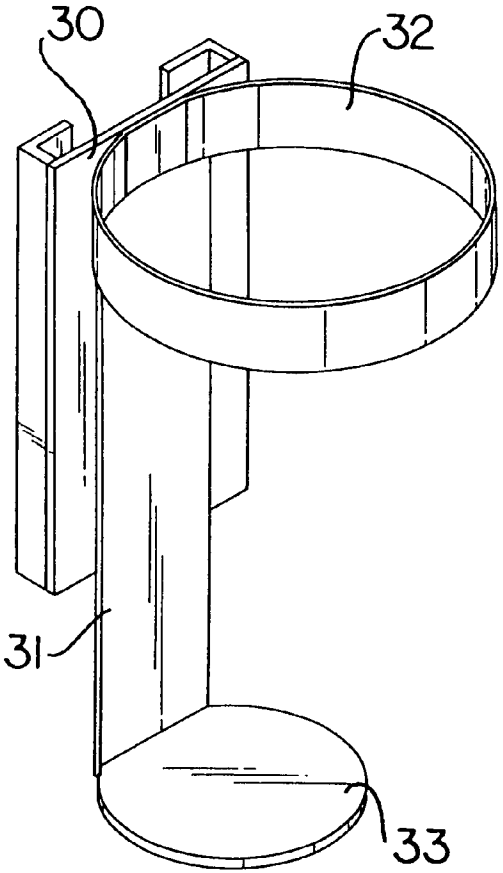
FIG. 6 is a detailed perspective view of the cup holder of the present invention.
Figure 5:
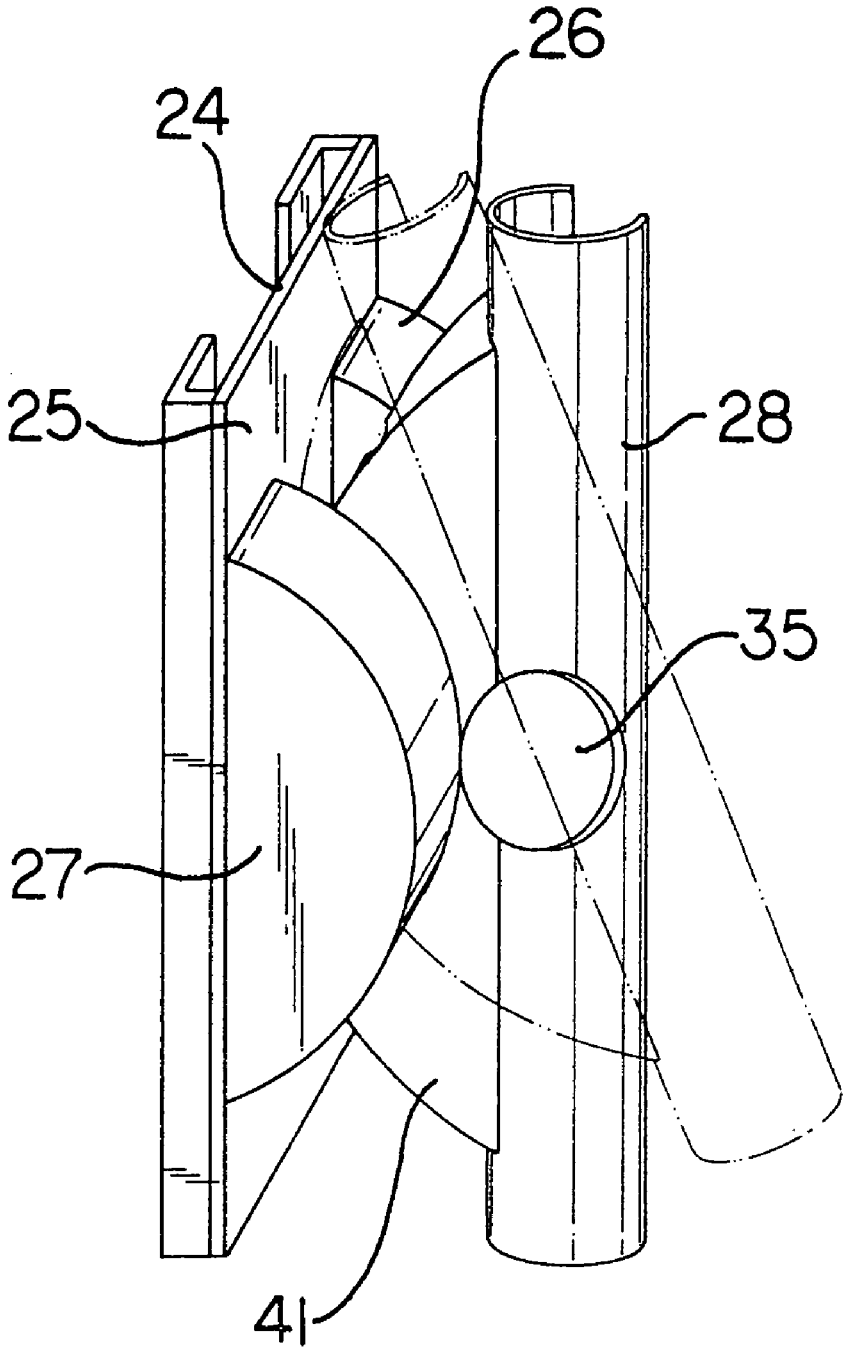
FIG. 5 is a detailed perspective view of the umbrella-holding bracket assembly of the present invention.

With reference now to the drawings, and in particular to FIGS. 1 through 6 thereof, a new umbrella/cup holder device embodying the principles and concepts of the present invention and generally designated by the reference numeral 10 will be described.

As best illustrated in FIGS. 1 through 6, the umbrella/cup holder device 10 generally comprises a harness 11 including a pair of shoulder straps 12,16, a cross strap 20 conventionally interconnecting the shoulder straps 12,16, and an adjustable belt 21 being conventionally attached to the shoulder straps 12,16 and having fastening members 22,23 being conventionally attached at ends thereof. Each of the shoulder straps 12,16 has loops 15,19 disposed at ends thereof. The adjustable belt 21 is extended through the loops 15,19 of the shoulder straps 12,16. The cross strap 20 is conventionally attached to the shoulder straps 12,16 intermediate of the loops 15,19 thereof. The fastening members 22,23 include a male-type buckle member 22 being securely and conventionally attached at one of the ends of the adjustable belt 21, and also include a female-type buckle member 23 being securely and conventionally attached to the other of the ends of the adjustable belt 21.

An umbrella-holding bracket assembly is securely and conventionally attached to one of the shoulder straps 12,16. The umbrella-holding bracket assembly includes a bracket support member 36 being securely and conventionally attached to a front side 13 of the shoulder strap 12 and having a plurality of holes 37 being spacedly disposed therethrough, and further includes a bracket member 24 being removably attached upon the bracket support member 36, and also includes an umbrella holder having a sleeve 28 and a sleeve support member 41 being securely welded to the sleeve 28 and being pivotally fastened to the bracket member 24, and further includes a sleeve fastener 29 being attached to the bracket member 24 for fastening the sleeve 28 to the bracket member 24, and also includes an umbrella fastener 35 being engagable to the shaft of the umbrella 40 being received in the sleeve 28. The bracket member 24 includes a base plate 25 having hook members extending from a back thereof and being received in said holes 37 of the bracket support member 36, and also includes lug members 26,27 being spaced apart and being securely and conventionally attached to a side of the base plate 25. The sleeve support member 41 is pivotally received between the lug members 26,27.

A cup holder is 30 securely attached to another of the shoulder straps 16. The cup holder 30 includes a plate support member 38 being securely and conventionally attached to the shoulder strap 16 and having a plurality of holes 39 being spacedly disposed therethrough, and further includes a plate member 31 having hook members extending from a back thereof and being removably received in the holes 39 of the plate support member 38, and also includes a ring member 32 being disposed perpendicular to and being securely and conventionally attached to the plate member 31, and further includes a platform member 33 being securely disposed perpendicular to and being securely and conventionally attached to the plate member 31 below the ring member 32. The ring member 32 is adapted to receive a cup therein, and the platform member 33 is adapted to support the cup thereon. A pocket 34 is securely and conventionally attached to one of the shoulder straps 16 for storing a folded-up umbrella 40 therein. The pocket 34 is securely attached to a back side 14 of the shoulder strap 12 and is adapted to receive and store the folded-up umbrella 40 therein.

In use, the user securely straps on the harness 11 and unfolds the umbrella 40 from the pocket 34 and places the shaft-through the sleeve 28 and secures the shaft of the umbrella 40 in the sleeve 28 using the sleeve fastener 29 so that the user can carry other items just as groceries in one's arms. The user can also carry a cup containing a beverage in the cup holder 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella/cup holder device comprising:

a harness including a pair of shoulder straps, a cross strap interconnecting said shoulder straps, and an adjustable belt being attached to said shoulder straps and having fastening members attached at ends thereof;

an umbrella-holding bracket assembly being securely attached to one of said shoulder straps;

a cup holder being securely attached to another of said shoulder straps; and a pocket being securely attached to one of said shoulder straps for storing a folded-up umbrella therein;

wherein said umbrella-holding bracket assembly includes an umbrella holder defining an elongate sleeve for receiving a portion of a shaft of the umbrella, said elongate sleeve defining openings at opposite ends of said sleeve, said elongate sleeve comprising a perimeter wall extending between said openings at said opposite ends, a slot extending through said perimeter wall and extending between said openings to permit the shaft of the umbrella to be inserted through said slot and into said sleeve such that the shaft passes through said openings;

wherein said umbrella-holding bracket assembly includes a bracket support member being securely attached to a front side of said shoulder strap and having a plurality of holes being spacedly disposed therethrough, and further includes a bracket member being removably attached upon said bracket support member, and said umbrella holder includes a sleeve support member being attached to said sleeve and being pivotally fastened to said bracket member, and further includes a sleeve fastener being attached to said bracket member for fastening said sleeve to said bracket member, and also includes an umbrella fastener being engagable to the shaft of the umbrella being received in said sleeve.

2. An umbrella/cup holder device as described in claim 1, wherein each of said shoulder straps has loops disposed at ends thereof.

3. An umbrella/cup holder device as described in claim 2, wherein said adjustable belt is extended through said loops of said shoulder straps.

4. An umbrella/cup holder device as described in claim 3, wherein said cross strap is attached to said shoulder straps intermediate of said loops thereof.

5. An umbrella/cup holder device as described in claim 1, wherein said fastening members include a male-type buckle member being securely attached at one of said ends of said adjustable belt, and also include a female-type buckle member being securely attached to the other of said ends of said adjustable belt.

6. An umbrella/cup holder device as described in claim 1, wherein said pocket is securely attached to a back side of said shoulder strap and is adapted to receive and store the folded-up umbrella therein.

7. An umbrella/cup holder device comprising:

a harness including a pair of shoulder straps, a cross strap interconnecting said shoulder straps, and an adjustable belt being attached to said shoulder straps and having fastening members attached at ends thereof;

an umbrella-holding bracket assembly being securely attached to one of said shoulder straps;

a cup holder being securely attached to another of said shoulder straps; and a pocket being securely attached to one of said shoulder straps for storing a folded-up umbrella therein;

wherein said umbrella-holding bracket assembly includes a bracket support member being securely attached to a front side of said shoulder strap and having a plurality of holes being spacedly disposed therethrough, and further includes a bracket member being removably attached upon said bracket support member, and also includes an umbrella holder having a sleeve and a sleeve support member being attached to said sleeve and being pivotally fastened to said bracket member, and further includes a sleeve fastener being attached to said bracket member for fastening said sleeve to said bracket member, and also includes an umbrella fastener being engagable to the shaft of the umbrella being received in said sleeve;

wherein said bracket member includes a base plate having hook members extending from a back thereof and being received in said holes of said bracket support member, and also includes lug members being spaced apart and being securely attached to a side of said base plate, said sleeve support member being pivotally received between said lug members.

8. An umbrella/cup holder device comprising:

a harness including a pair of shoulder straps, a cross strap interconnecting said shoulder straps, and an adjustable belt being attached to said shoulder straps and having fastening members attached at ends thereof;

an umbrella-holding bracket assembly being securely attached to one of said shoulder straps;

a cup holder being securely attached to another of said shoulder straps; and a pocket being securely attached to one of said shoulder straps for storing a folded-up umbrella therein;

wherein said cup holder includes a plate support member being securely attached to said shoulder strap and having a plurality of holes being spacedly disposed therethrough, and further includes a plate member having hook members extending from a back thereof and being removably received in said holes of said plate support member, and also includes a ring member being disposed perpendicular to and being securely attached to said plate member, and further includes a platform member being securely disposed perpendicular to and being securely attached to said plate member below said ring member, said ring member being adapted to receive a cup therein and said platform member being adapted to support the cup thereon.

9. An umbrella/cup holder device as described in claim 1, wherein each of said shoulder straps has loops disposed at ends thereof, said adjustable belt being extended through said loops of said shoulder straps, said cross strap being attached to said shoulder straps intermediate of said loops thereof, said fastening members including a male-type buckle member being securely attached at one of said ends of said adjustable belt, and also including a female-type buckle member being securely attached to the other of said ends of said adjustable belt;

said bracket member including a base plate having hook members extending from a back thereof and being received in said holes of said bracket support member, and also including lug members being spaced apart and being securely attached to a side of said base plate, said sleeve support member being pivotally received between said lug members;

wherein said cup holder including a plate support member is securely attached to said shoulder strap and having a plurality of holes being spacedly disposed therethrough, and further including a plate member having hook members extending from a back thereof and being removably received in said holes of said plate support member, and also including a ring member being disposed perpendicular to and being securely attached to said plate member, and further including a platform member being securely disposed perpendicular to and being securely attached to said plate member below said ring member, said ring member being adapted to receive a cup therein and said platform member being adapted to support the cup thereon; and wherein said pocket is securely attached to a back side of said shoulder strap and being adapted to receive and store the folded-up umbrella therein.

* * * * *